US010245610B2

(12) United States Patent
Johnson

(10) Patent No.: US 10,245,610 B2
(45) Date of Patent: Apr. 2, 2019

(54) ON-WALL SHOWER SYSTEM

(71) Applicant: DELTA FAUCET COMPANY, Indianapolis, IN (US)

(72) Inventor: Brian Wayne Johnson, Muncie, IN (US)

(73) Assignee: Delta Faucet Company, Indianapolis, IN (US)

( * ) Notice: Subject to any disclaimer, the term of this patent is extended or adjusted under 35 U.S.C. 154(b) by 33 days.

(21) Appl. No.: 15/348,523

(22) Filed: Nov. 10, 2016

(65) Prior Publication Data

US 2017/0157634 A1 Jun. 8, 2017

Related U.S. Application Data

(60) Provisional application No. 62/263,996, filed on Dec. 7, 2015.

(51) Int. Cl.

| | |
|---|---|
| ***B05B 15/60*** | (2018.01) |
| ***B05B 1/18*** | (2006.01) |
| ***E03C 1/02*** | (2006.01) |
| ***B05B 15/62*** | (2018.01) |
| ***B05B 1/16*** | (2006.01) |
| ***E03C 1/04*** | (2006.01) |

(52) U.S. Cl.

CPC ..... *B05B 15/62* (2018.02); *B05B 1/1645* (2013.01); *B05B 1/18* (2013.01); *E03C 1/025* (2013.01); *E03C 1/0408* (2013.01); *E03C 1/0409* (2013.01); *E03C 2201/30* (2013.01)

(58) Field of Classification Search

CPC ..... E03C 1/042

USPC ..... 4/615, 596

See application file for complete search history.

(56) References Cited

U.S. PATENT DOCUMENTS

| | | | | |
|---|---|---|---|---|
| 4,523,604 | A | 6/1985 | Hutto | |
| 4,809,369 | A * | 3/1989 | Bowden | A47K 3/32 239/310 |
| 4,997,007 | A | 3/1991 | Niemann et al. | |
| 5,291,622 | A * | 3/1994 | Humpert | E03C 1/042 137/359 |
| 5,329,650 | A | 7/1994 | Zaccai et al. | |
| 5,339,469 | A | 8/1994 | Gilles | |
| 6,038,715 | A | 3/2000 | Flieger et al. | |
| 6,829,790 | B2 | 12/2004 | Petrovic et al. | |
| 6,859,955 | B2 | 3/2005 | Hudson | |
| 7,043,776 | B1 | 5/2006 | Wu | |
| 7,356,857 | B2 | 4/2008 | Rosenberg | |
| 7,406,984 | B2 | 8/2008 | Nikles et al. | |
| 7,458,112 | B1 | 12/2008 | Yang | |
| 7,857,241 | B2 | 12/2010 | Deng | |
| 8,156,579 | B2 | 4/2012 | Renfrew | |
| 8,191,185 | B2 | 6/2012 | Tsai | |
| 8,429,769 | B2 | 4/2013 | Gross | |
| 8,505,567 | B1 | 8/2013 | Wu | |
| 8,683,624 | B1 | 4/2014 | Zhadanov et al. | |
| 8,684,039 | B2 * | 4/2014 | Cai | E03C 1/0408 137/801 |
| 9,273,452 | B2 | 3/2016 | Wilson | |

(Continued)

*Primary Examiner* — Janie M Loeppke

(74) *Attorney, Agent, or Firm* — Faegre Baker Daniels LLP

(57) ABSTRACT

An on-wall shower system that is configured to be retrofit to existing in-wall shower plumbing. To assist in installation, the on-wall shower system provides for adjustability of an upper amount, for adjustably of a lower mount, and/or for axial height adjustment.

19 Claims, 17 Drawing Sheets

(56) References Cited

U.S. PATENT DOCUMENTS

| | | | | |
|---|---|---|---|---|
| 9,677,256 | B2 | 6/2017 | Wilson | |
| 2002/0083518 | A1 | 7/2002 | D'Ugo | |
| 2003/0226200 | A1 | 12/2003 | Charonis | |
| 2005/0116062 | A1 | 6/2005 | Yang | |
| 2005/0127211 | A1 | 6/2005 | Yeiser | |
| 2006/0021131 | A1 | 2/2006 | Robert et al. | |
| 2006/0196972 | A1 | 9/2006 | Kajuch | |
| 2008/0105805 | A1 | 5/2008 | Glunk | |
| 2009/0265848 | A1 | 10/2009 | Tsai | |
| 2009/0266913 | A1 | 10/2009 | Tsai | |
| 2012/0151669 | A1* | 6/2012 | Wilson | E03C 1/066 4/615 |
| 2013/0248017 | A1 | 9/2013 | Neagoe | |
| 2013/0283520 | A1 | 10/2013 | Schulte | |
| 2013/0283524 | A1 | 10/2013 | Schulte | |
| 2016/0177552 | A1 | 6/2016 | Wilson | |
| 2017/0233988 | A1 | 8/2017 | Wilson | |

* cited by examiner

ON-WALL SHOWER SYSTEM

CROSS-REFERENCE TO RELATED APPLICATION

The present application claims priority to U.S. Provisional Patent Application Ser. No. 62/263,996, filed Dec. 7, 2015, the disclosure of which is expressly incorporated herein by reference.

BACKGROUND AND SUMMARY OF THE DISCLOSURE

The present application relates generally to shower plumbing fixtures and, more particularly, to an on-wall shower system that may be retrofit to existing in-wall shower plumbing. Consumers often desire the look of an exposed pipe shower, where the vertical piping connection between the valve and the shower arm is outside of the shower wall versus concealed inside the shower wall. Tub/shower valves are typically kept in place for up to 30 years due to the difficulty and expense of having them replaced. The ability to add other useful features/items, such as a hand shower, or converting to a system with a drastically different appearance and function, such as an on-wall shower system, can be hampered by these difficulties in replacement.

As such, it is desired to provide a shower system having the ability to add features without the need to disturb the shower wall structure or finish, such as breaking tile supported by the shower wall. Such activity is disruptive, and can be expensive because of the skilled trades involved. A device that could be installed on the shower wall by the homeowner, using a standard existing valve body as its water supply, would eliminate the need for such difficult installation and resulting expenses.

The present invention relates to an on-wall shower mounting system illustratively including a tubular main body having an upper supply/shower arm connection, an adjustable hand shower nest, a diverter valve and a main hub. The shower mounting system attaches to a pre-existing main control valve and drop eared elbow in the shower wall. The design is configured to work with a variety of existing control valves. For some installations, the upper supply/shower arm connection may not be located exactly above the main control valve. This offset would not normally be noticeable in a typical shower installation because the main control valve and the shower arm have no visible connection outside of the shower wall. By connecting these two points with the on-wall shower system, even a relatively small offset may become noticeable, which might be undesirable from an aesthetic perspective.

One illustrative feature of the on-wall shower mounting system of the present disclosure is the supply elbow connector that has an eccentric arrangement, thereby allowing the installer to rotatably adjust its position to accommodate a lateral offset (out of plumb) between the upper supply/shower arm connection and the lower main control valve. Additionally, the system of the present disclosure includes a lower tube section between the diverter valve and the main control valve that doesn't carry water and, as such, may be trimmed to length by the installer to accommodate a range of distances between the upper supply/shower arm connection and the lower main control valve. Furthermore, an adjustable connection is provided between the valve handles and the valve cartridge of the main control valve. Because the shower mounting system is affixed to the outside surface of the finished shower wall, but the position of the valve/cartridge relative to the finished shower wall can vary from installation to installation, an adjustment means is provided to connect the external handles to the internal valve cartridge.

According to an illustrative embodiment of the present disclosure, a shower mounting system includes a riser assembly having a riser tube extending between a lower end and an upper end, and a connector supported by the upper end of the riser tube. A lower mount is operably coupled to the lower end of the riser tube, and an upper mount is operably coupled to the connector of the riser assembly. The upper mount includes a supply elbow having a rearwardly facing inlet tube configured to be fluidly coupled to a water supply pipe supported by a shower wall and defining a rotational axis, and a forwardly facing outlet tube fluidly coupled to the connector of the riser assembly and defining an outlet axis. The rotational axis is spaced apart from the outlet axis such that the outlet tube is eccentrically mounted relative to the inlet tube, thereby providing for a lateral adjustment of the outlet tube as the supply elbow is rotated about the rotational axis.

According to another illustrative embodiment of the present disclosure, a shower mounting system includes a riser assembly having a riser tube extending between a lower end and an upper end, and a connector supported by the upper end of the riser tube. The riser assembly further includes a first fluid conduit received within the riser tube and extending between a lower fluid coupler and an upper fluid coupler, and a second fluid conduit received within the riser tube and extending parallel to the first fluid conduit between a lower fluid coupler and an upper fluid coupler. A lower mount is operably coupled to the lower end of the riser tube, and an upper mount is operably coupled to the connector of the riser assembly. The upper mount is configured to permit lateral adjustment of the upper end of the riser tube.

According to a further illustrative embodiment of the present disclosure, a shower mounting system includes a riser assembly having a riser tube extending between a lower end and an upper end, and a connector supported by the upper end of the riser tube. The riser assembly further includes a first fluid conduit received within the riser tube and extending between a lower end and an upper end, and a second fluid conduit received within the riser tube and extending parallel to the first fluid conduit between a lower end and an upper end. An upper mount is operably coupled to the connector of the riser assembly, and the lower mount is operably coupled to the lower end of the riser tube. A shower arm includes an inlet end and an outlet end, the inlet end being fluidly coupled to the connector of the riser assembly. A showerhead is fluidly coupled to the outlet end of the shower arm, and a hand shower is supported by the riser assembly. A diverter valve is supported by the lower end of the riser tube and is configured to selectively divert water between the showerhead and the hand shower.

Additional features and advantages of the present invention will become apparent to those skilled in the art upon consideration of the following detailed description of the illustrative embodiment exemplifying the best mode of carrying out the invention as presently perceived.

BRIEF DESCRIPTION OF DRAWINGS

The present invention is best described with reference to the accompanying figures, in which.

DETAILED DESCRIPTION OF THE DRAWINGS

Figure 1:
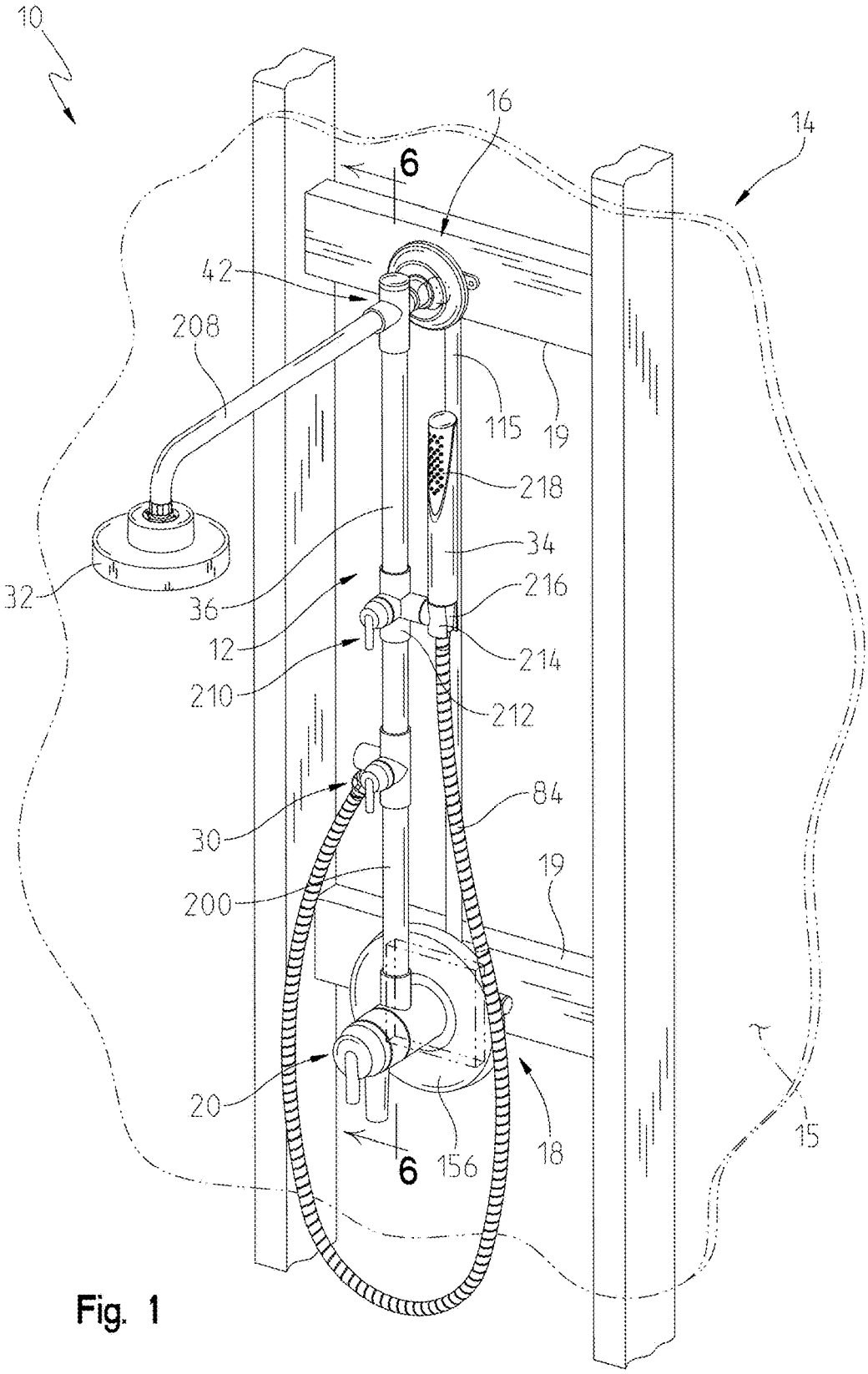
FIG. 1 is a perspective view of an on-wall shower system of the present disclosure.

For the purposes of promoting an understanding of the principles of the present disclosure, reference will now be made to the embodiments illustrated in the drawings, which are described herein. The embodiments disclosed herein are not intended to be exhaustive or to limit the invention to the precise form disclosed. Rather, the embodiments are chosen and described so that others skilled in the art may utilize their teachings. Therefore, no limitation of the scope of the claimed invention is thereby intended. The present invention includes any alterations and further modifications of the illustrated devices and described methods and further applications of the principles of the invention which would normally occur to one skilled in the art to which the invention relates.

Figure 2:
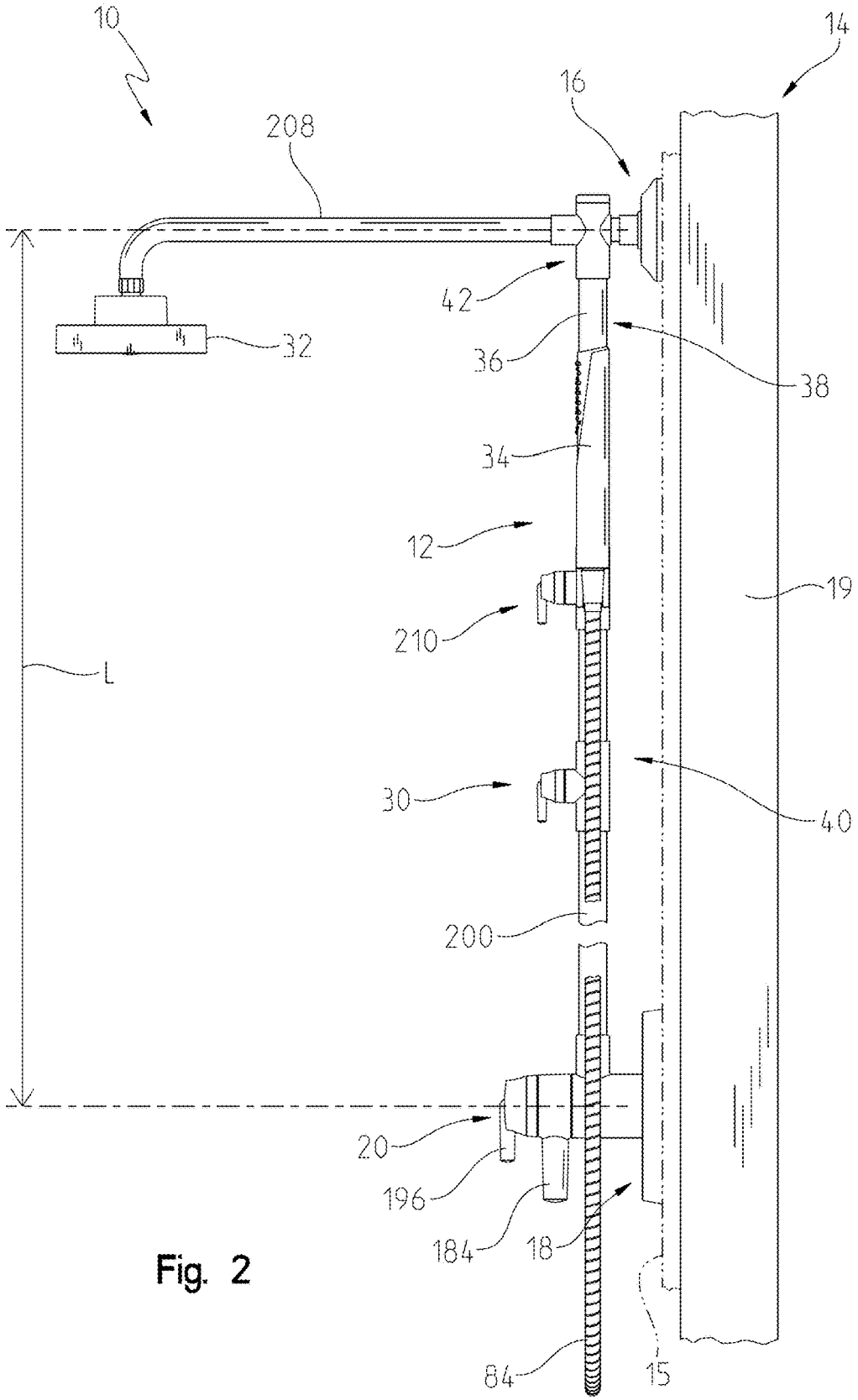
FIG. 2 is a side elevational view of the on-wall shower system of FIG. 1.
Figure 3:
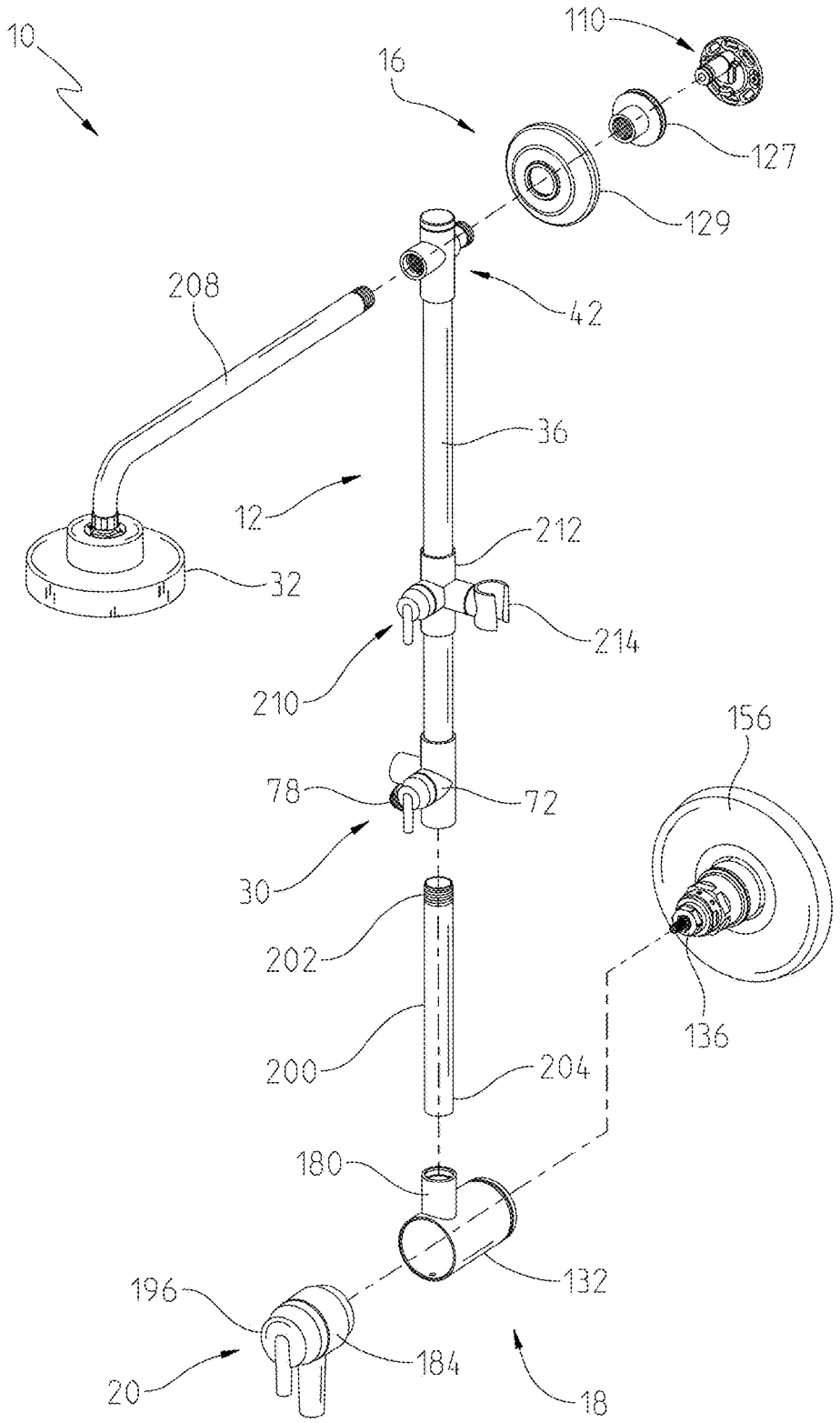
FIG. 3 is an exploded perspective view of the on-wall shower system of FIG. 1.
Figure 8:
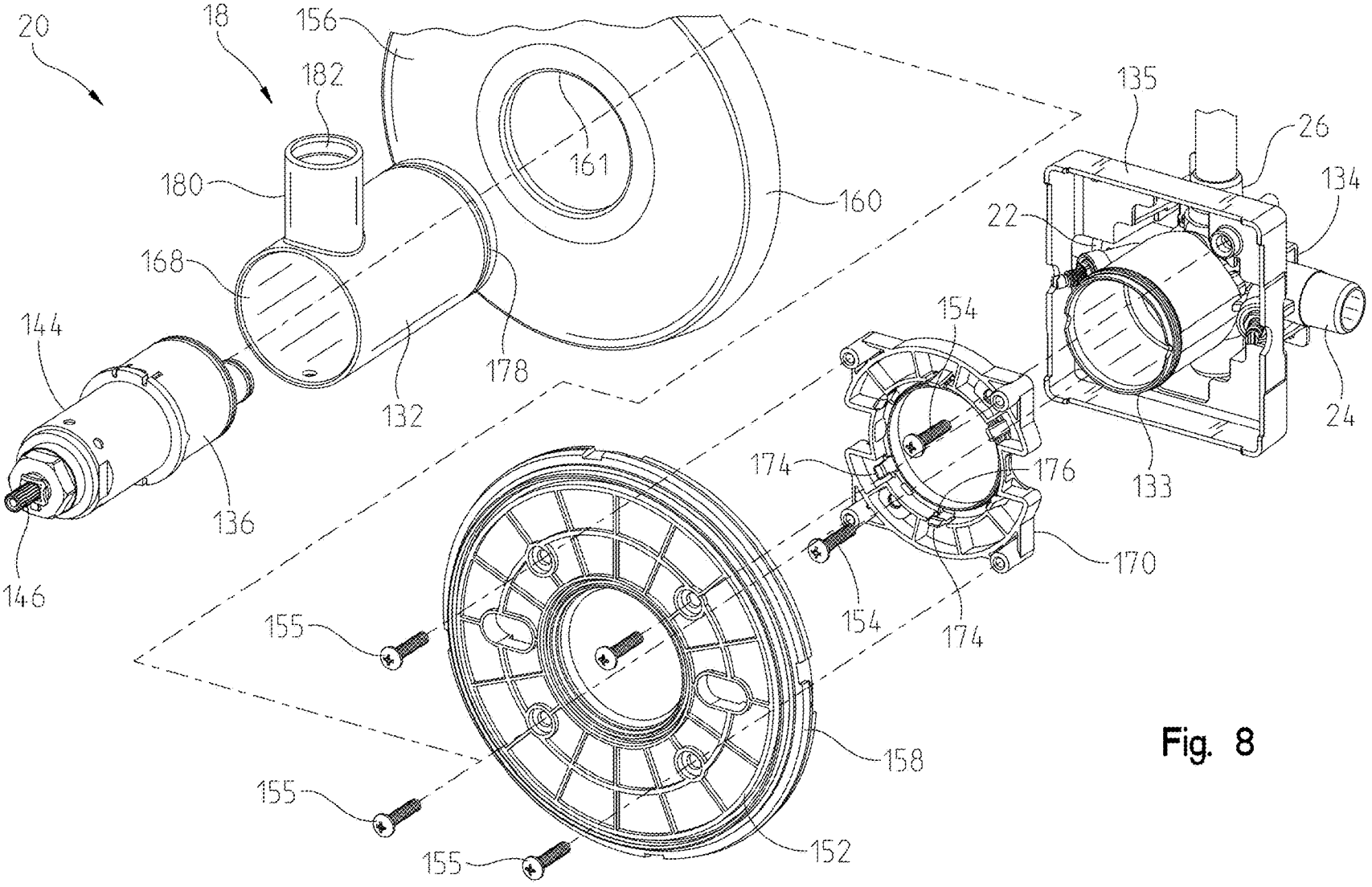
FIG. 8 is a second detailed perspective view of the lower mount of the on-wall shower system of FIG. 1, showing coupling of the mounting hub to the main control valve.

With reference initially to FIGS. 1-3, an illustrative shower mounting system 10 of the present disclosure includes a riser assembly 12 supported external to a conventional shower wall 14 (i.e., forward of an outer surface 15), and extending between an upper mount 16 and a lower mount 18. The upper mount 16 and the lower mount 18 are illustratively secured to studs 19 of the shower wall 14. A main control valve 20 includes a hot water inlet 22 fluidly coupled to a hot water supply, a cold water inlet 24 fluidly coupled to a cold water supply, and an outlet 26 fluidly coupled to the riser assembly 12 through the lower mount 18 (FIG. 8). A diverter valve 30 is fluidly coupled to the riser assembly 12 and is configured to selectively divert water between an overhead showerhead 32 and a hand shower 34.

Figure 6:
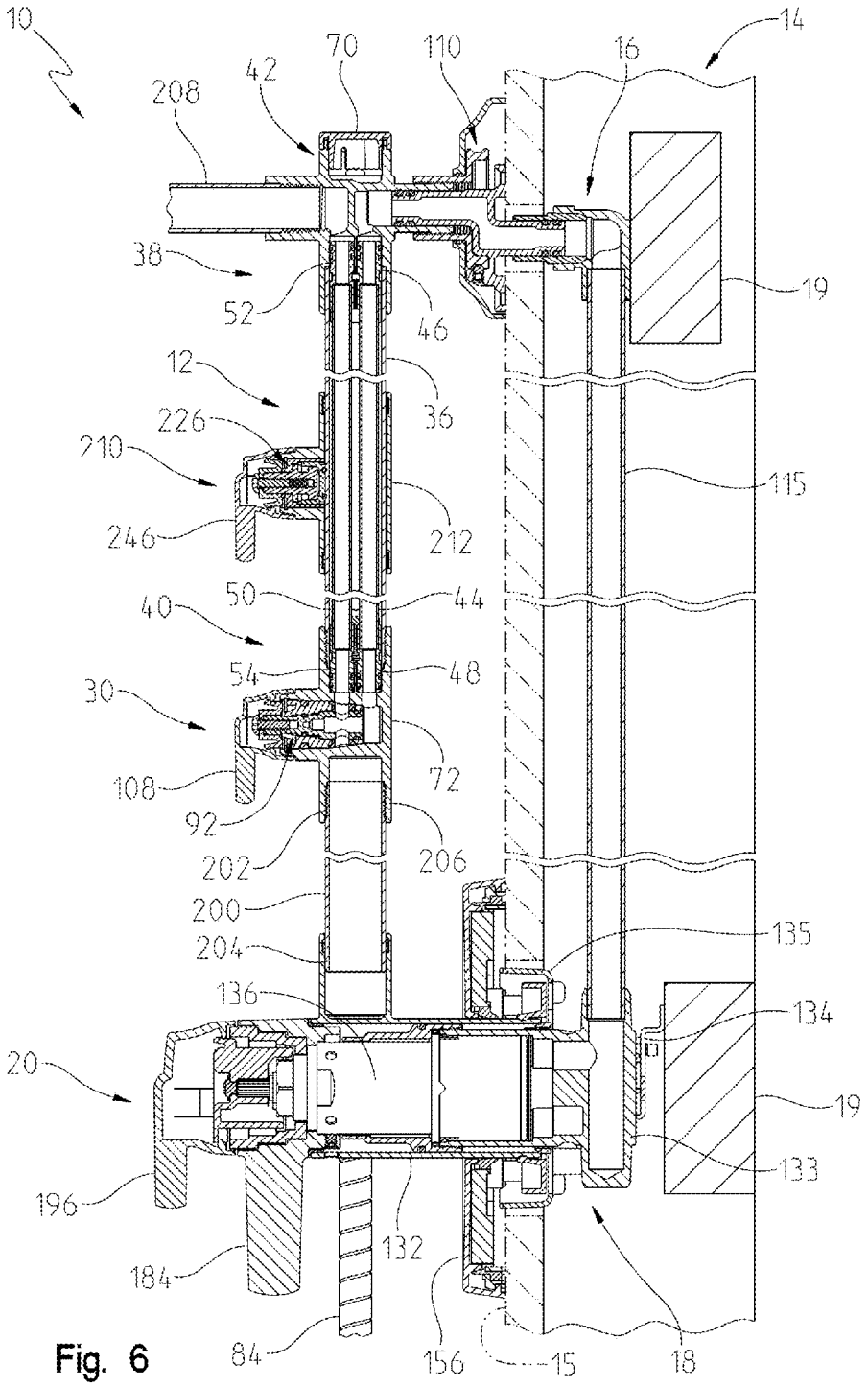
FIG. 6 is a cross-sectional view taken along line 6-6 of FIG. 1.
Figure 9:
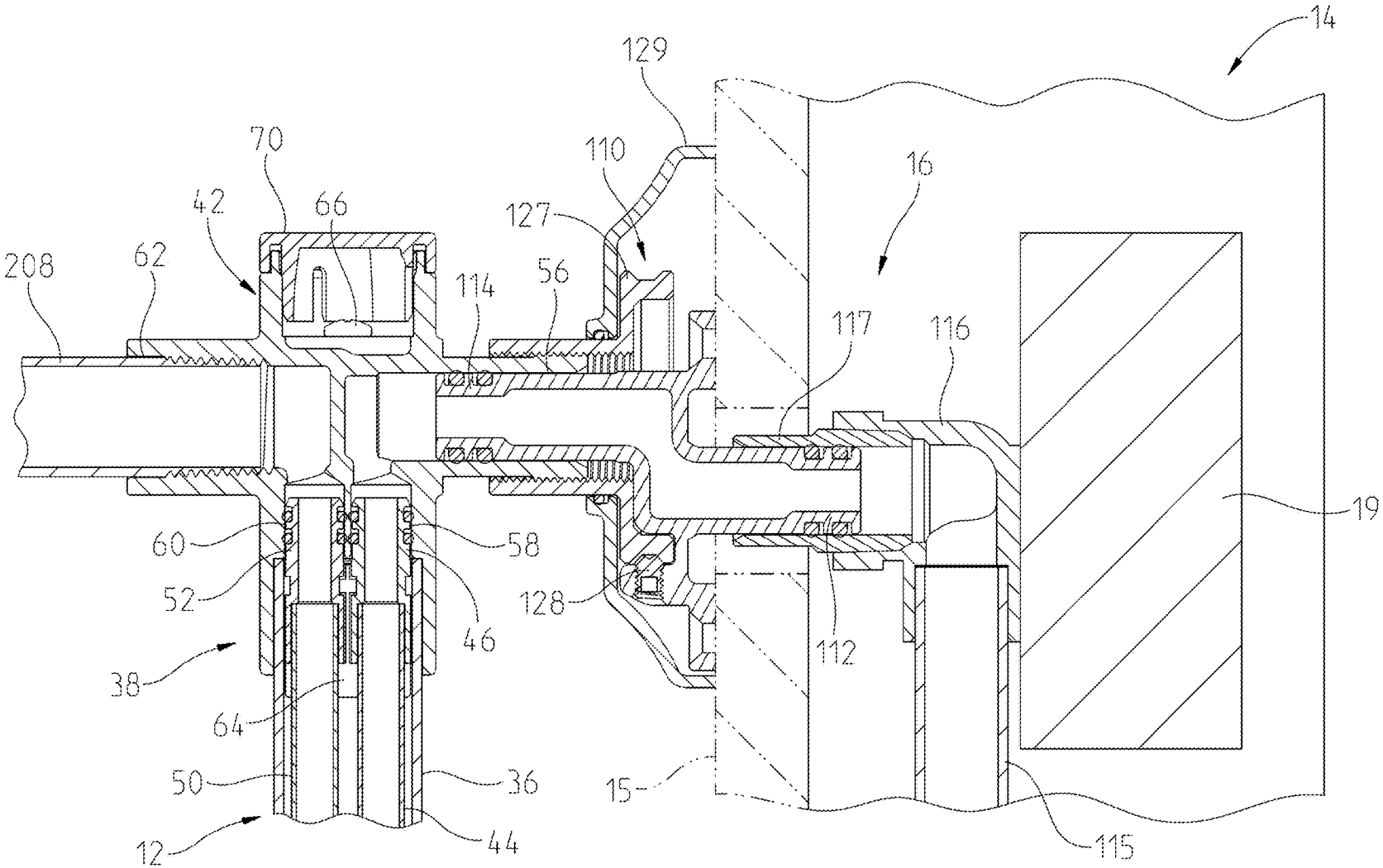
FIG. 9 is a detailed cross-sectional view of FIG. 6, showing the connector of the riser assembly operably coupled to the upper mount.

With further reference to FIGS. 6 and 9, the riser assembly 12 illustratively includes an outer riser tube 36 extending between an upper end 38 and a lower end 40. An upper connector 42 is fluidly coupled to the upper end 38 of the riser tube 36, and the diverter valve 30 is fluidly coupled to the lower end 40 of the riser tube 36. A first fluid conduit 44 is received within the outer riser tube 36 and extends between an upper fluid coupler 46 and a lower fluid coupler 48. A second fluid conduit 50 is received within the riser tube 36 and extends parallel to the first fluid conduit 44 between an upper fluid coupler 52 and a lower fluid coupler 54.

With reference to FIG. 9, the illustrative upper connector 42 of the riser assembly 12 includes a first inlet port 56 fluidly coupled to a first outlet port 58, and a second inlet port 60 fluidly coupled to a second outlet port 62. The upper fluid coupler 46 of the first fluid conduit 44 is sealingly received within the first outlet port 58, while the upper fluid coupler 52 of the second fluid conduit 50 is sealingly received within the second inlet port 60. A holder 64 may clamp together the upper fluid couplers 46 and 52 of the first and second fluid conduits 44 and 50, and is supported within the outer riser tube 36. Fasteners, illustratively a pair of bolts 66, secure the holder 64 within the upper connector 42 of the riser assembly 12. A cap 70 is illustratively coupled to the upper connector 42 and covers the bolts 66.

Figure 11:
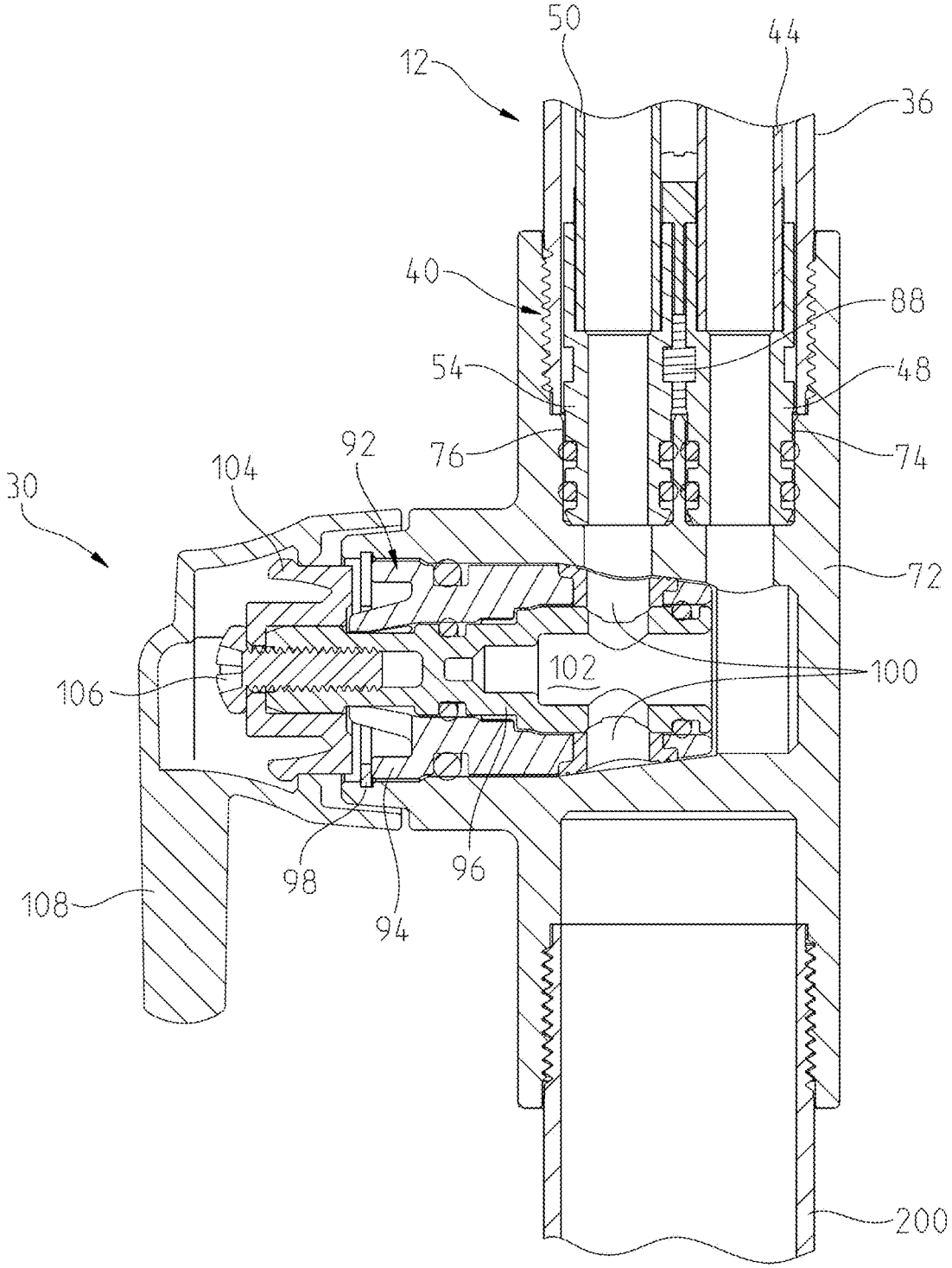
FIG. 11 is a detailed cross-sectional view of FIG. 6, showing the diverter valve fluidly coupled to the riser assembly.

With reference to FIGS. 6 and 11, the diverter valve 30 is supported by the lower end 40 of the riser tube 36 and is fluidly coupled to the first and second fluid conduits 44 and 50. The diverter valve 30 illustratively includes a valve body 72 including an inlet port 74, a first outlet port 76, and a second outlet port 78 (FIG. 3). The inlet port 74 is fluidly coupled to the first fluid conduit 44. The first outlet port 76 is fluidly coupled to the second fluid conduit 50 which, in turn, is fluidly coupled to the overhead showerhead 32. The second outlet port 78 is fluidly coupled to the hand shower 34, illustratively through a flexible hose 84 (FIG. 1). The lower end 40 of the outer riser tube 36 is threadably coupled to the diverter valve body 72. A holder 88 may clamp together the lower fluid couplers 48 and 54 of the first and second fluid conduits 44 and 50, and is supported within the riser tube 36. Fasteners, illustratively a pair of bolts (not shown), may secure the holder 88 within the diverter valve body 72.

A valve member 92 is supported within the valve body 72 such that movement of the valve member 92 diverts water from the inlet port 74 to one of the first outlet port 76 and the second outlet port 78. The valve member 92 illustratively includes a diverter cylinder 94 receiving a diverter stem 96. A retaining ring 98 illustratively secures the diverter cylinder 94 within the valve body 72.

The diverter stem 96 illustratively includes openings 100 defining a passageway 102 that is selectively alignable with either the first outlet port 76 or the second outlet port 78. The diverter stem 96 is illustratively secured to a diverter handle adapter 104 via a fastener, such as a bolt 106. A diverter control handle 108 receives the handle adapter 104 such that rotation of the handle 108 causes rotation of the handle adapter 104 and the diverter stem 96, thereby diverting water flow between the first outlet port 76 (and the overhead showerhead 32) and the second outlet port 78 (and the hand shower 34).

With reference to FIGS. 4-6 and 9, the upper mount 16 illustratively includes a supply elbow 110 having a rearwardly facing inlet tube 112 and a forwardly facing outlet tube 114. The inlet tube 112 is configured to be fluidly coupled to a conventional water supply pipe 115, illustratively through a drop-eared elbow 116, supported by the shower wall 14. The water supply pipe 115 is illustratively positioned behind the outer surface 15 of the shower wall 14 and fluidly couples the main control valve 20 with the supply elbow 110.

Figure 4:
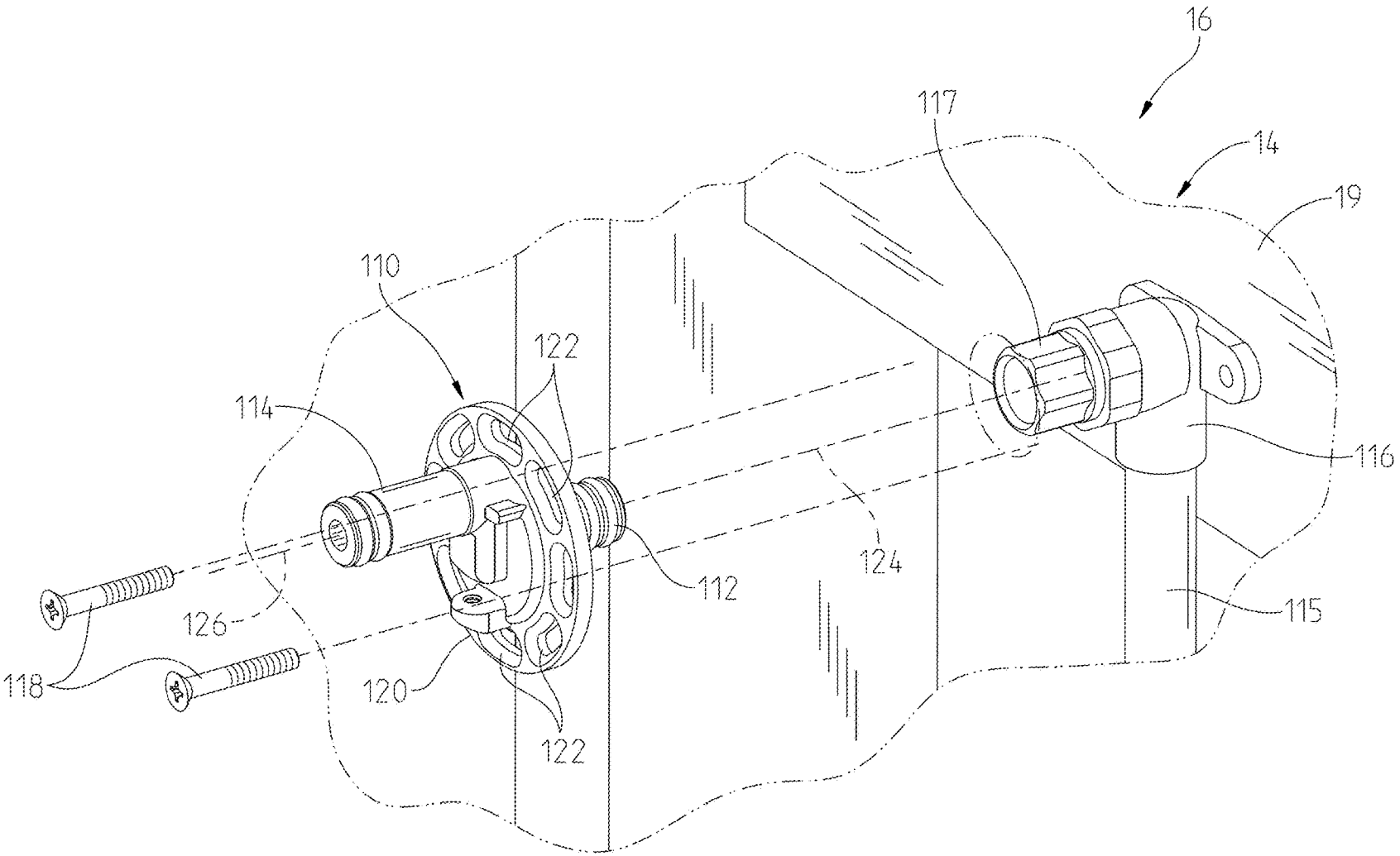
FIG. 4 is a detailed perspective view of the upper mount of the on-wall shower system of FIG. 1.

A supply adapter 117 may threadably couple with the elbow 116 and the inlet tube 112 of the supply elbow 110. The inlet tube 112 of the supply elbow 110 inserts into the supply adapter 117 and is secured to the shower wall 14 with anchors, such as screws 118 (FIG. 4). The supply elbow 110 illustratively includes a circular mounting flange 120 including a plurality of circumferentially spaced openings 122 to receive the anchors 118.

The rearwardly facing inlet tube 112 of the supply elbow 110 defines a rotational axis 124. The forwardly facing outlet tube 114 is fluidly coupled to the riser assembly 12 and defines an outlet axis 126. The rotational axis 124 is spaced apart from the outlet axis 126 such that the inlet tube 112 is eccentrically mounted relative to the outlet tube 114. As such, lateral adjustment of the outlet tube 114 is provided as the supply elbow 110 is rotated about the rotational axis 124 (as shown by FIGS. 5A and 5B).

A supply anchor 127 couples the supply elbow 110 with the upper connector 42. More particularly, a set screw 128 secures the supply anchor 127 to the supply elbow 110, and the upper connector 42 threadably couples with the supply anchor 127. The outlet tube 114 of the supply elbow 110 is received within the first inlet port 56 of the upper connector 42. A supply escutcheon 129 is received over the supply anchor 127.

Figure 5A:
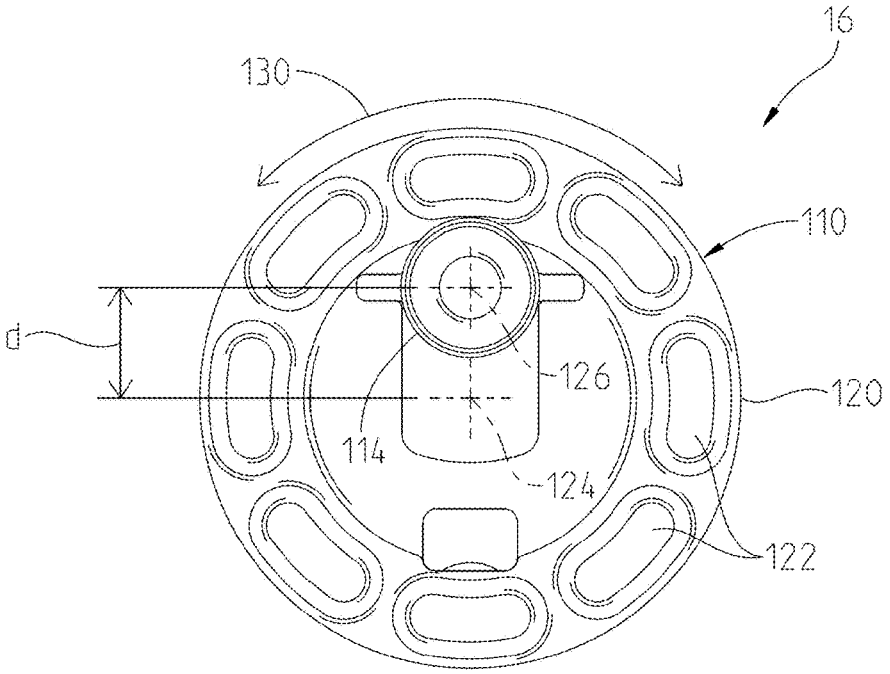
FIG. 5A is a front view of the upper mount of FIG. 4 in a first position.
Figure 5B:
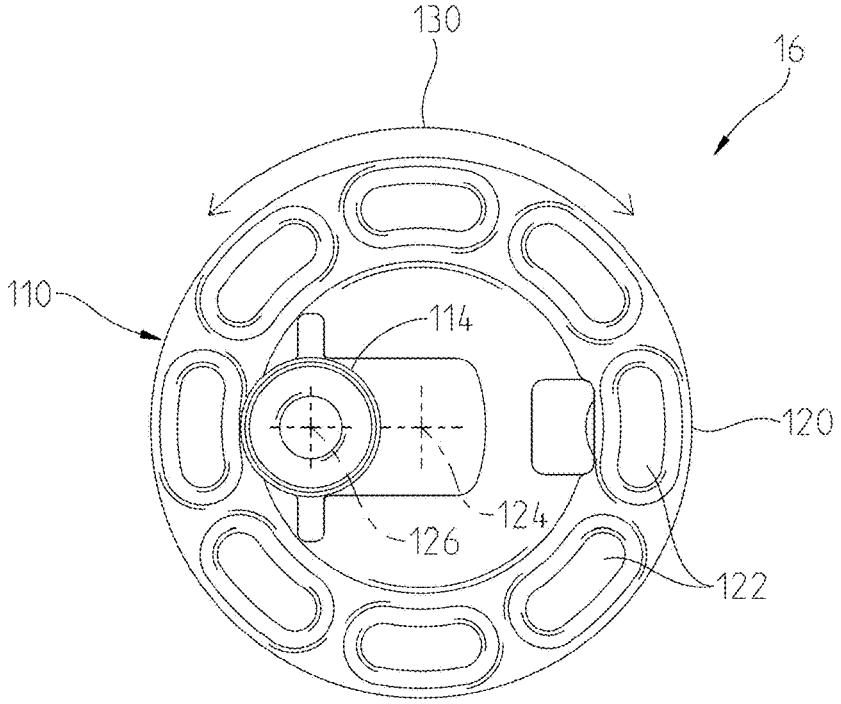
FIG. 5B is a front view of the upper mount of FIG. 4 in a second position rotated counterclockwise from the first position.

With reference now to FIGS. 5A and 5B, lateral adjustment of the upper mount 16 is illustrated in response to rotational movement thereof. More particularly, FIG. 5A illustrates the upper mount 16 in a first position where the outlet axis 126 of the outlet tube 114 is positioned vertically above the rotational axis 124 of the inlet tube 112. The vertical distance (d) between the rotational axis 124 and the outlet axis 126 is illustratively 0.5 inches. In FIG. 5B, the supply elbow 110 has been rotated counter-clockwise (as shown by arrow 130) by 90 degrees. As such, the outlet axis 126 in FIG. 5B is laterally offset from the rotational axis 124 by horizontal distance (d), illustratively 0.5 inches. As may be appreciated, rotation of the supply elbow 110 by −90 degrees (i.e., counter-clockwise) laterally adjusts the outlet axis 126 to the left by distance (d) relative to the rotational axis 124, while rotation of the supply elbow 110 by +90 degrees (i.e., clockwise) laterally adjusts the outlet axis 126 to the right by distance (d) relative to the rotational axis 124.

With reference to FIGS. 6-8 and 12, the lower mount 18 illustratively includes a mounting hub 132 concentrically received around the main control valve 20 supported within the shower wall 14. The main control valve 20 includes a valve body 133 coupled to a support bracket 134 for securing the control valve 20 to stud 19 of the shower wall 14. A plaster guard 135 may be coupled to the valve body 133. As is known, the plaster guard 135 provides a guide for an installer applying tile to the shower wall 14.

A conventional valve cartridge 136 is received within the valve body 133 and is configured to control the flow of water from the hot water inlet 22 and the cold water inlet 24 to the outlet 26. The outlet 26 is fluidly coupled with the supply elbow 110 via the water supply pipe 115. The valve cartridge 136 may be a conventional thermostatic valve cartridge including a volume control input 144 and a temperature control input 146, illustratively a valve stem. A mounting nut 148 illustratively secures the valve cartridge 136 within the valve body 133. An o-ring 150 is illustratively supported by the mounting nut 148.

Figure 12:
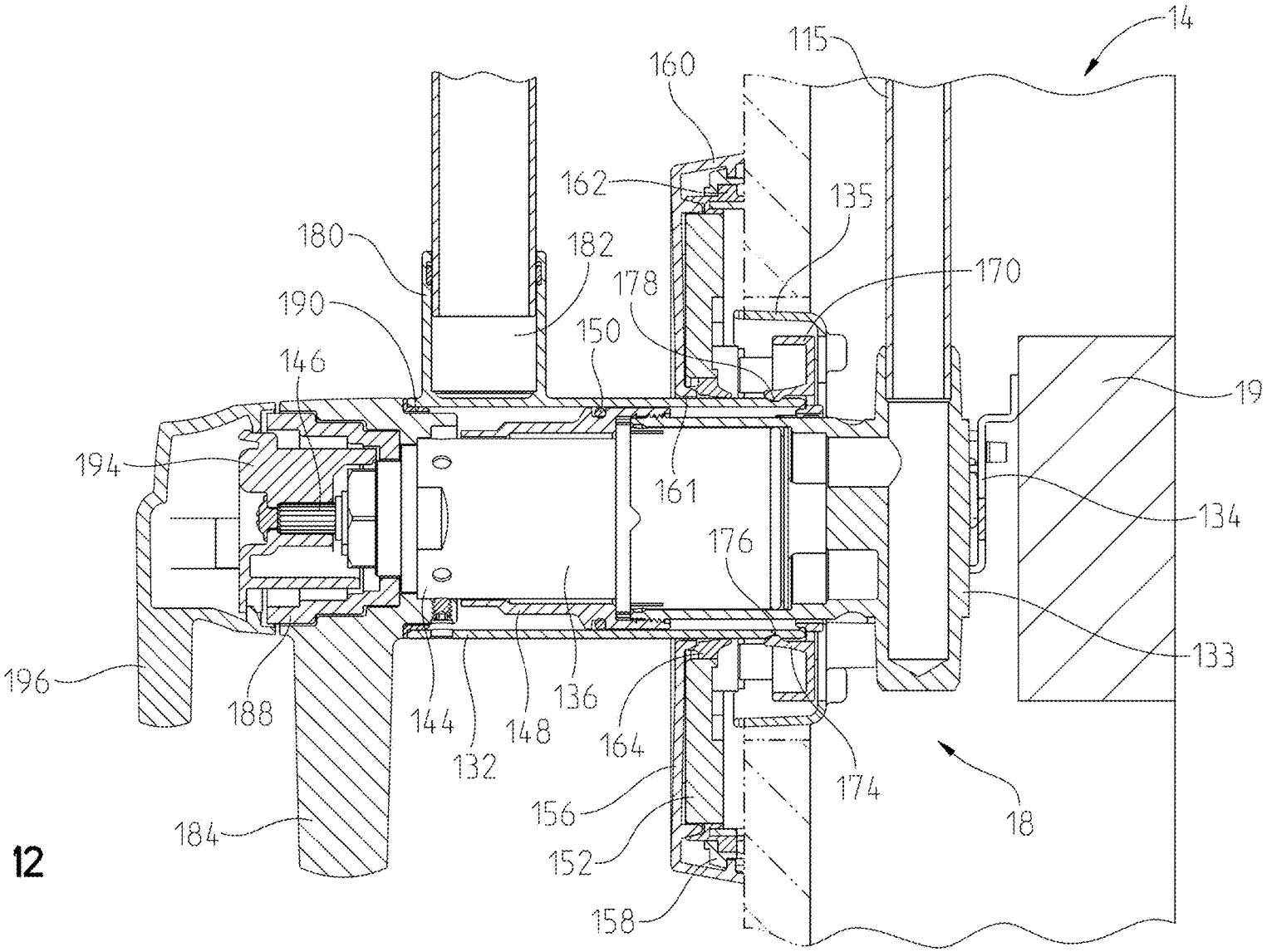
FIG. 12 is a detailed cross-sectional view of FIG. 6, showing the lower mount and main control valve.
Figure 13:
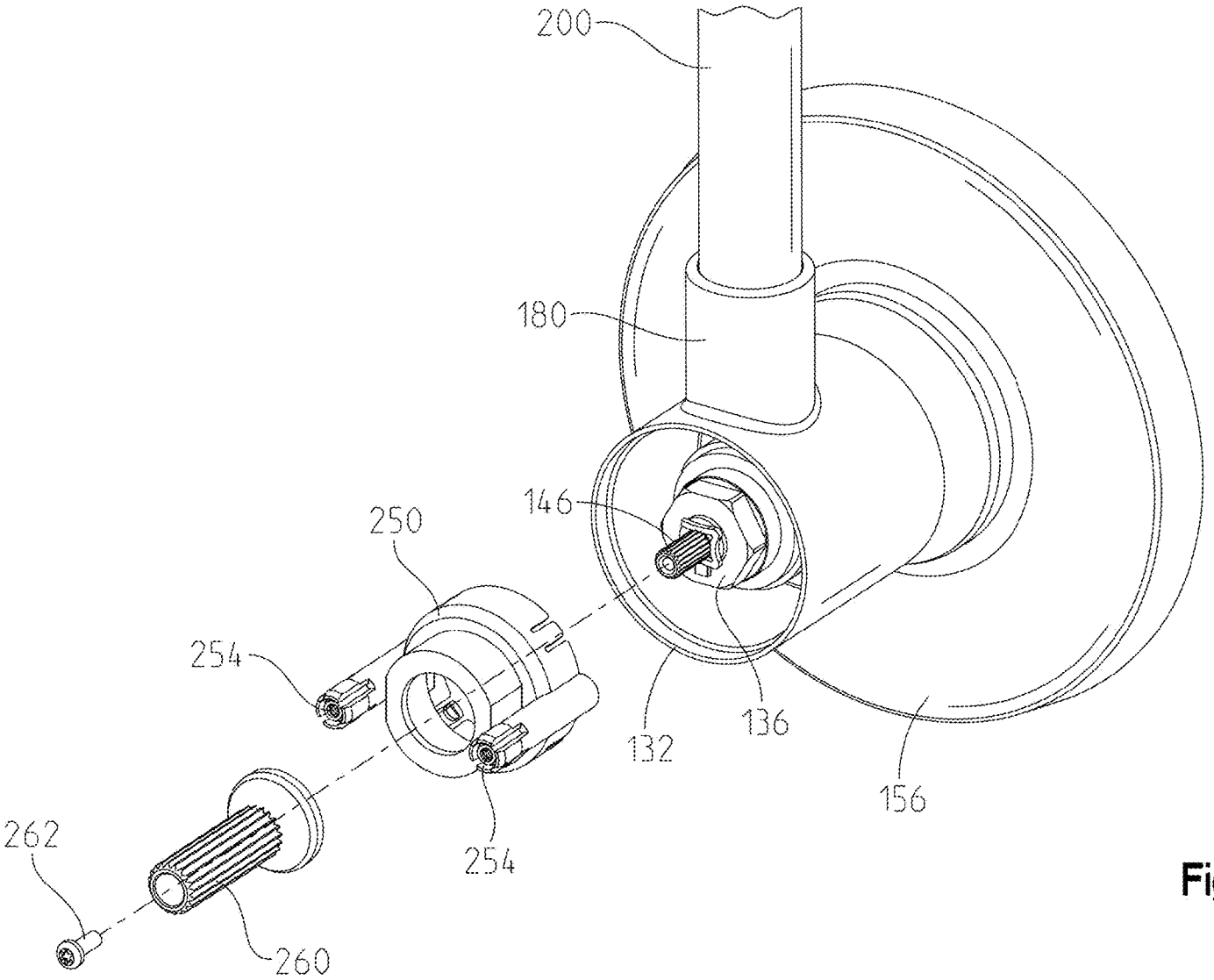
FIG. 13 is a perspective view of an alternative handle mounting.
Figure 14:
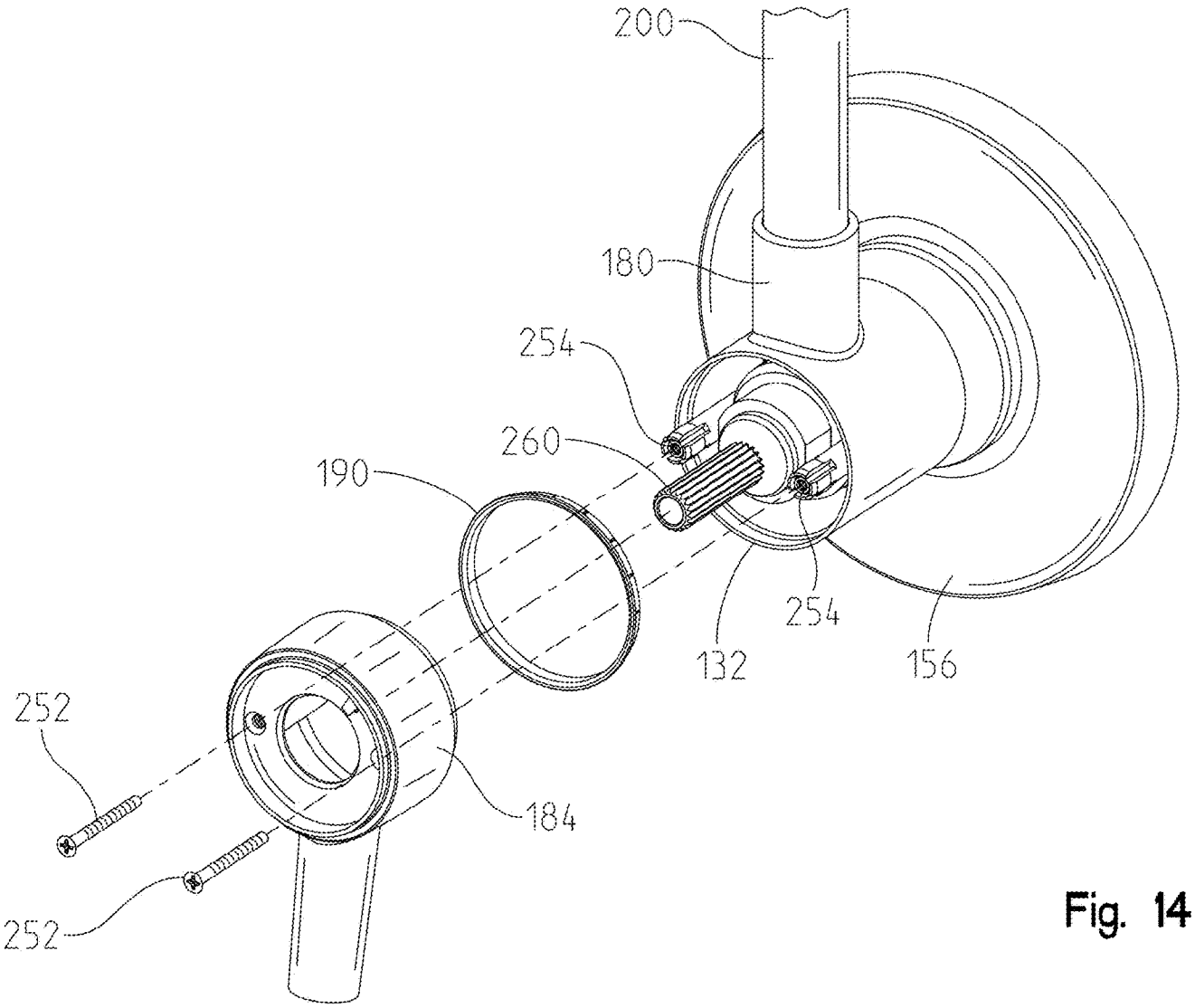
FIG. 14 is a perspective view of the volume control handle mounting of FIG. 13.

With reference to FIG. 12, a retainer 170 is coupled to the support bracket 134 through conventional fasteners, such as screws 154. This clamps the plaster guard 135 between the support bracket 134 and the retainer 170. A wall plate 152 couples to the retainer 170 with fasteners, such as screws 155. An escutcheon 156 is received over the wall plate 152 and secured thereto via a fastener, such as a locking ring 158. An outer seal 162 may extend between the wall plate 152 and the wall 14, and between the wall plate 152 and the escutcheon 156. An inner seal 164 may extend between the wall plate 152 and the mounting hub 132. The seals 162 and 164 may be overmolded with the wall plate 152. The escutcheon 156 illustratively includes an outer flange 160 to conceal the wall plate 152, and a center opening 161 to receive the mounting hub 132.

With reference to FIGS. 8 and 12, the mounting hub 132 includes a cylindrical body 168 that slides over the mounting nut 148 and may be secured in place via the retainer 170. The retainer 170 illustratively includes a plurality of flexible fingers 174 which are biased radially inwardly toward the mounting hub 132. Each finger 174 includes a lip 176 configured to be received within a groove 178 to axially secured the mounting hub 132 in position. A receiver 180 extends upwardly from the mounting hub 132 and is configured to support the riser assembly 12.

During assembly, the escutcheon 156 is illustratively pushed over the wall plate 152 and then rotated into place, locking into the locking ring 158. The mounting hub 132 is then pushed through the opening 161 in the escutcheon 156, engaging the inner wall plate seal 162, and snapping into place with the lips 176 of fingers 174 engaging groove 178 in the mounting hub 132.

Figure 7:
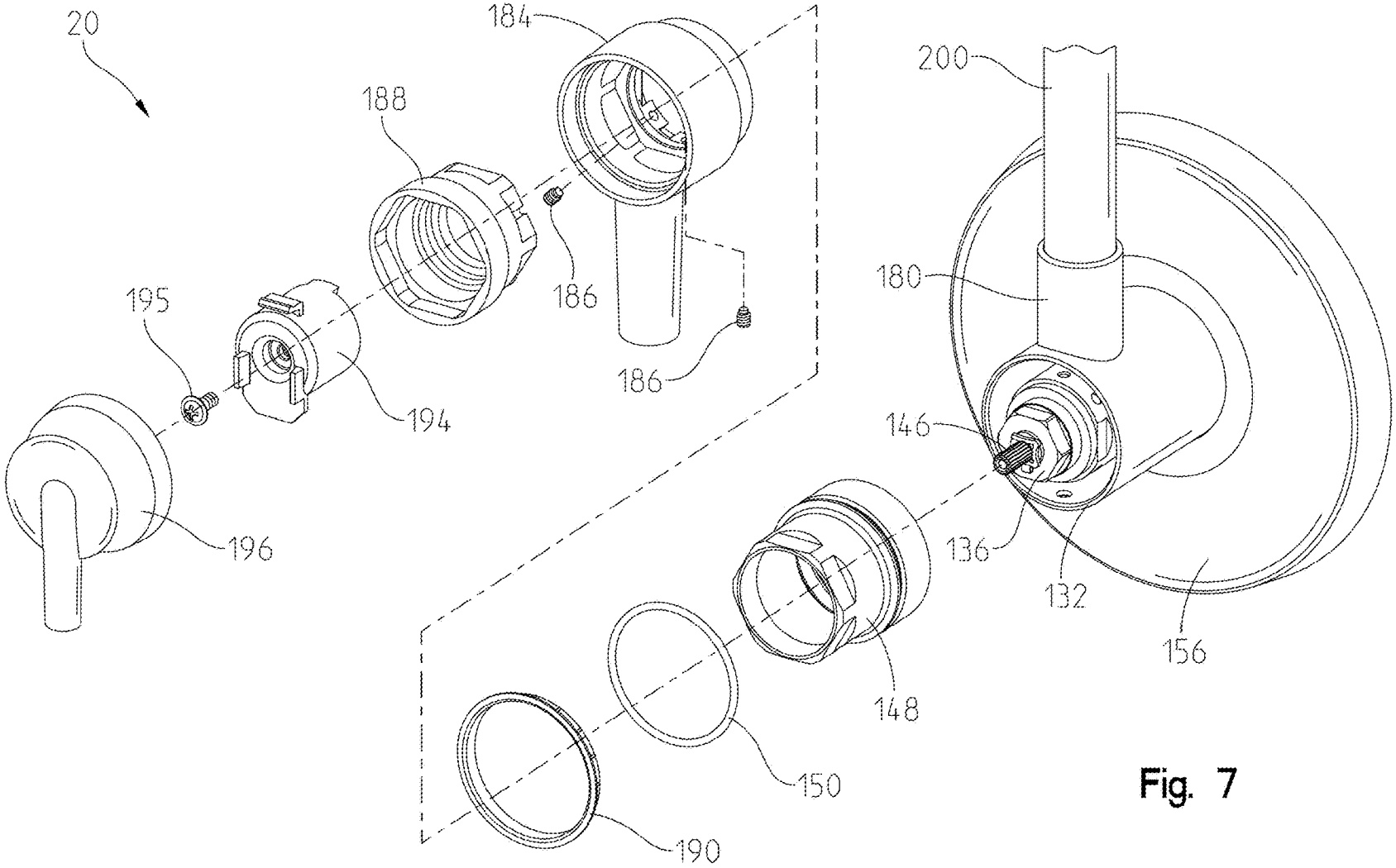
FIG. 7 is a first detailed perspective view of the lower mount of the on-wall shower system of FIG. 1, showing coupling of the volume and temperature control handles.

With reference to FIGS. 7 and 12, a volume control handle 184 is illustratively coupled to the volume control input 144 of the valve cartridge 136 via set screws 186. A mounting nut 188 includes a stop configured to interact with the temperature control handle adapter 194 to limit rotation of the temperature control stem 146. The nut 188 also acts as an extension tool for removing the mounting nut 148 without having to remove the mounting hub 132. Screws 186 engage with recesses in the cartridge 136 to hold the handle 184 in place. The interface between the adapter 194 and the stem 146 is a spline and, as such, allows a user to reposition the adapter 194 on the stem 146 to change the amount of rotation before engaging the stop of the mounting nut 188 (and limiting the amount of rotation of the handle 184).

A glide ring 190 may be positioned axially intermediate the volume control handle 184 and the mounting hub 132. A temperature control handle adapter 194 is illustratively secured to the temperature control stem 146 of the valve cartridge 136 via a screw 195. A temperature control handle 196 is illustratively coupled to the temperature control handle adapter 194 to allow a user to rotate the stem 146 and control temperature of water provided to the outlet 26 of the valve body 133 and, therefore to the water supply pipe 115.

With reference to FIGS. 1-3 and 6, an extension tube 200 extends axially between an upper end 202 and a lower end 204. The upper end 202 of the extension tube 200 is illustratively coupled to the lower end of the riser tube 36 through the diverter valve 30. The lower end 204 of the extension tube 200 is illustratively coupled to the mounting hub 132. The extension tube 200 is coupled to the lower end of the riser tube 36, and is fluidly sealed from the riser tube 36, thereby allowing for axial adjustment of the distance between the lower mount 18 and the upper mount 16. In other words, since the extension tube 200 is fluidly sealed from the riser assembly 12, the extension tube 200 may be cut to different lengths to accommodate different axial distances (L) between the upper mount 16 and the lower mount 18. Illustratively, the distance (L) between the upper mount 16 and the lower mount 18 may vary between 24 inches and 38 inches, with a nominal distance (L) of 31 inches. The upper end 202 of the extension tube 200 illustratively threads into the lower end 206 of the diverter valve body 72. The lower end 204 of the extension tube 200 is illustratively coupled to the lower mount 18 (FIG. 6).

The overhead showerhead 32 is fluidly coupled to the outlet of the upper connector 42 via a conventional tubular shower arm 208. The hand shower 34 is fluidly coupled to the second outlet of the diverter valve 30 via flexible hose 84. As detailed above, operation of the diverter valve 30 switches outlet water flow between the overhead showerhead 32 and the hand shower 34.

Figure 10:
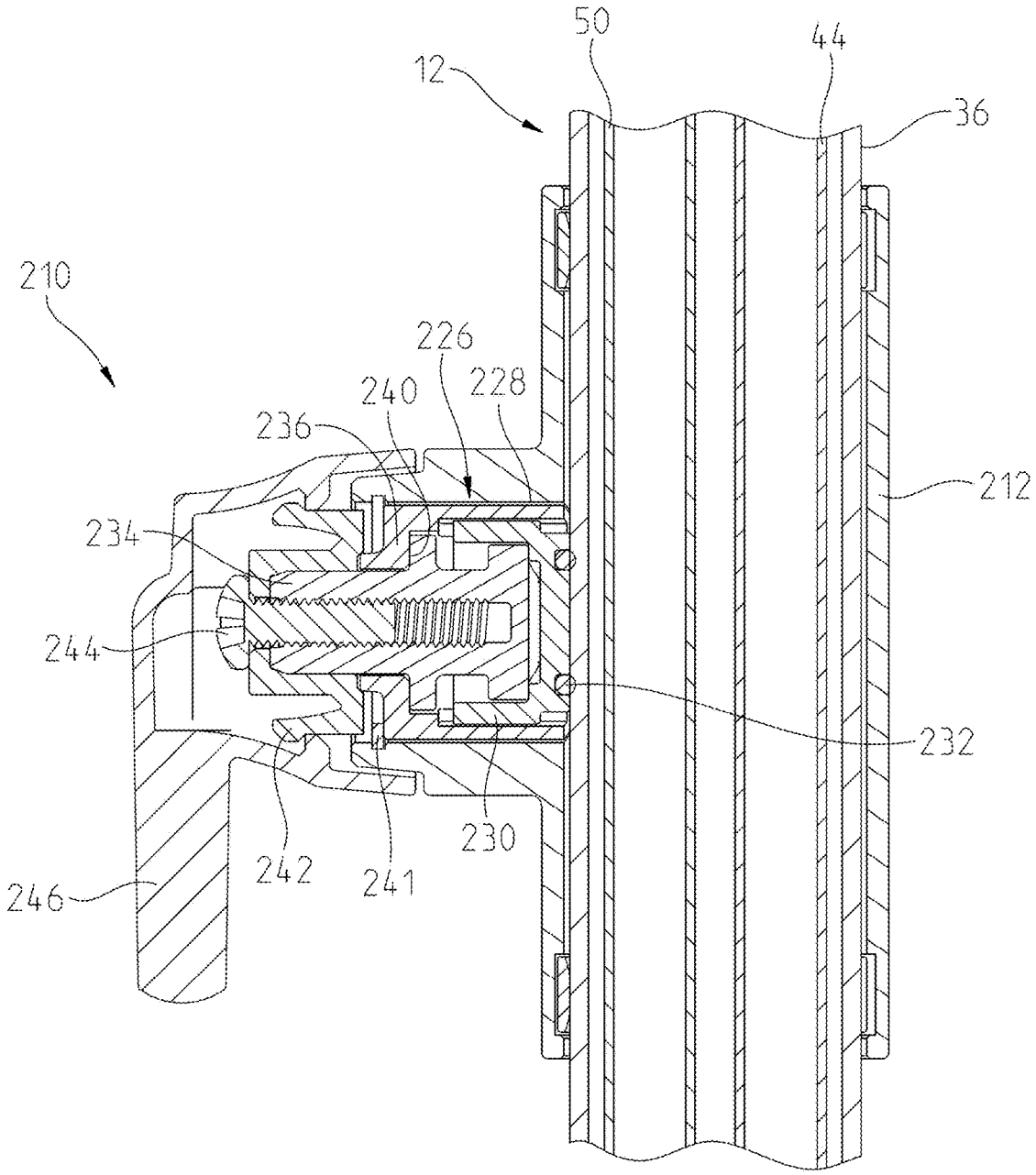
FIG. 10 is detailed cross-sectional view of FIG. 6, showing the hand shower operably coupled to the riser assembly.

With reference to FIGS. 3, 6 and 10, a hand shower nest 210 is supported for sliding movement along the riser tube 36. The hand shower nest 210 includes a body 212 supporting a nest arm or cradle 214. The hand shower 34 includes a handle 216 supporting a shower head 218, wherein the handle 216 is removably received within the nest arm 214 (FIG. 1). The nest arm 214 is secured to the body 212 via a conventional fastener, such as a screw (not shown). A spring biased detent (not shown) may secure the nest arm 214 in one of a plurality of rotational positions. In one illustrative embodiment, the nest arm 214 is configured to rotate in 20 degree increments in both directions, up to 40 degrees in both directions (i.e., 80 degree total rotation).

With reference to FIGS. 6 and 10, a brake assembly 226 is configured to secure the hand shower nest 210 in a desired axial position along the riser tube 36. The brake assembly 226 is received within a radial receiving bore 228 defined by the body 212. The brake assembly 226 illustratively includes a brake shoe 230 supporting an o-ring 232, a brake stem 234, and a brake housing 236 including a cam surface 240. A retaining ring 241 illustratively secures the brake assembly 226 within the receiving bore 228. A handle adapter 242 and screw 244 secures a brake control handle 246 to the brake assembly 226. Rotation of the brake control handle 246 causes the cam surface 240 of the brake housing 236 to move the brake shoe 230 into and out of engagement with the riser tube 36 to lock and release the hand shower nest 210 relative to the riser assembly 12.

FIGS. 13-17 illustrate a further illustrative embodiment handle mounting for coupling the volume control handle 184 and the temperature control handle 196 to the valve cartridge 136. In the following description, similar components to those of FIGS. 1-12 are identified with like reference numbers.

Figure 15:
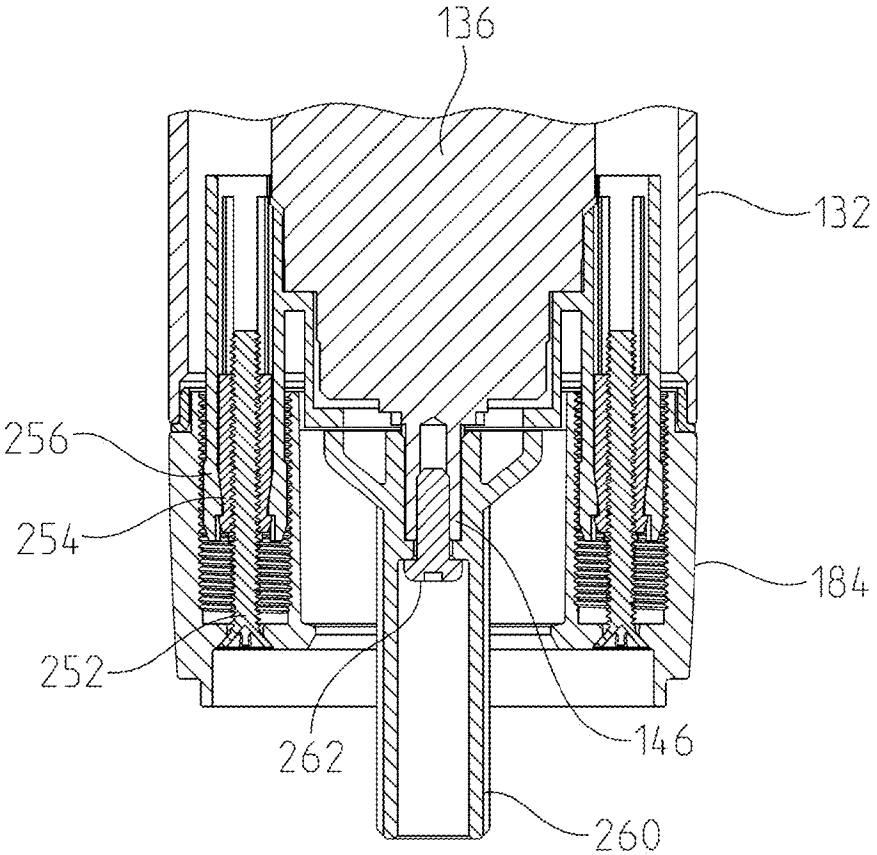
FIG. 15 is a cross-sectional view of the volume control handle mounting of FIG. 13.
Figure 16:
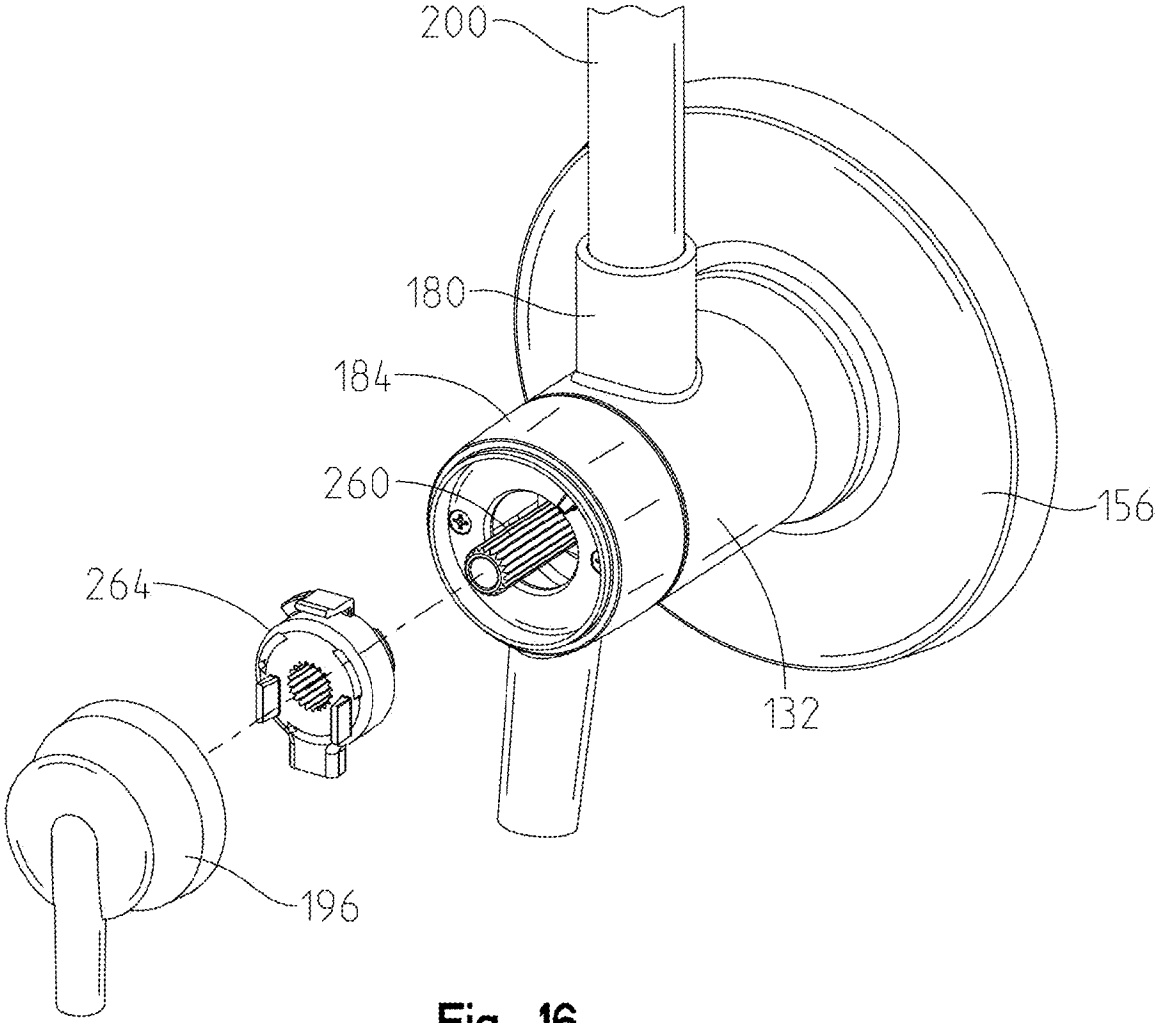
FIG. 16 is a perspective view of the temperature control handle mounting of FIG. 13.
Figure 17:
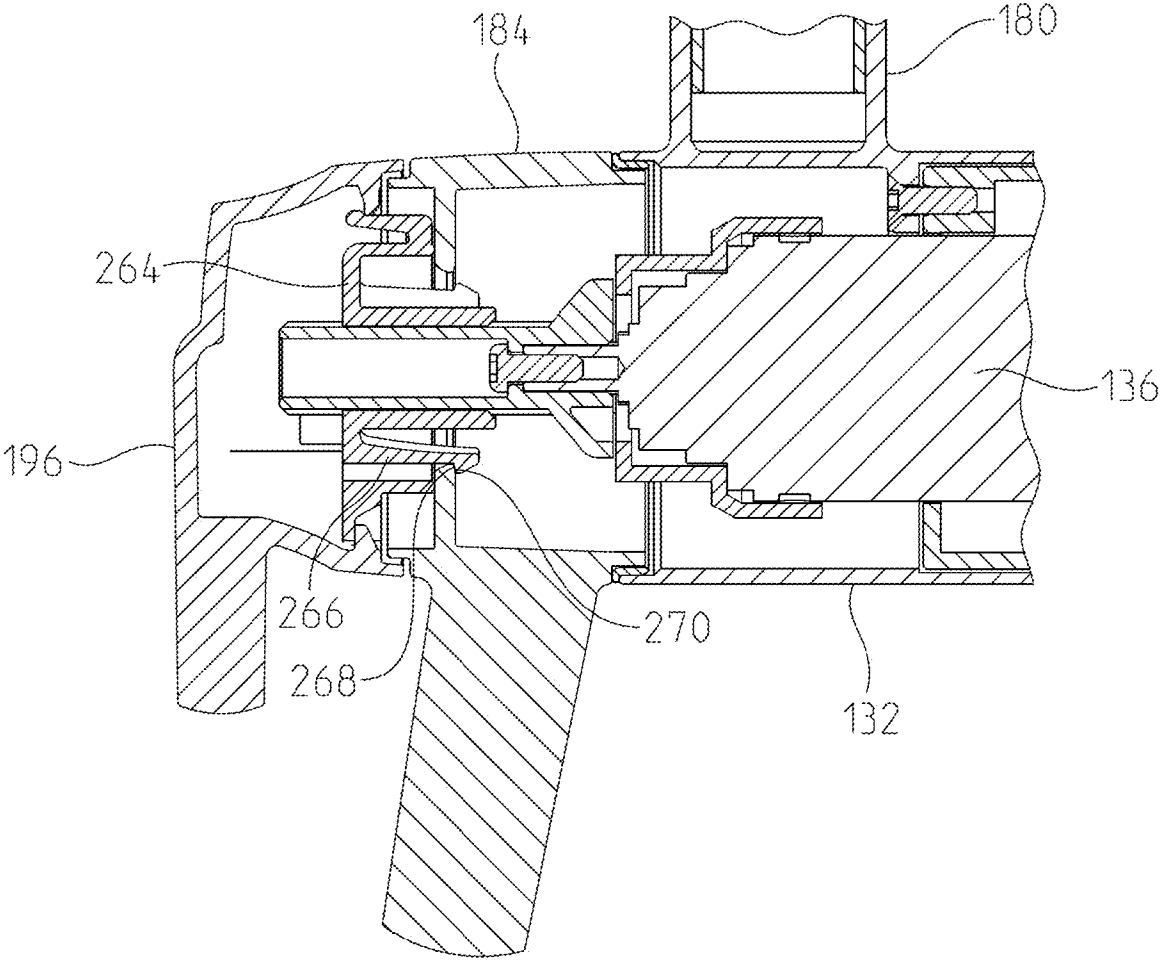
FIG. 17 is a cross-sectional view of the temperature control handle mounting of FIG. 16.

A volume control handle adapter 250 is coupled to the valve cartridge 136 via conventional fasteners, such as snaps that engage into recesses in the valve cartridge 136. The volume control handle adapter 250 illustratively includes expansion ferrules 254 configured to receive bolts 252 for expanding bosses 256 on the adapter 250 to hold the volume control handle 184 in place (FIG. 15). The glide ring 190 may be positioned axially intermediate the volume control handle 184 and the mounting hub 132.

A stem extension 260 is illustratively coupled to the stem 146 of the valve cartridge 136 via screw 262. A temperature control handle adapter 264 is coupled to the stem extension 260, illustratively through a snap connection, such as fingers 266 including lips 268 configured to snap over a flange 270 of the volume control handle 184. The temperature control handle 196 is secured to the temperature control handle adapter 264.

Although the invention has been described in detail with reference to certain preferred embodiments, variations and modifications exist within the spirit and scope of the invention as described and defined in the following claims.

The invention claimed is:

1. A shower mounting system comprising:

a riser assembly including a riser tube extending between a lower end and an upper end, and a connector supported by the upper end of the riser tube;

a lower mount operably coupled to the lower end of the riser tube; and an upper mount operably coupled to the connector of the riser assembly, the upper mount including a supply elbow having a rearwardly facing inlet tube configured to be fluidly coupled to a water supply pipe supported by a shower wall and defining a rotational axis, a forwardly facing outlet tube fluidly coupled to the connector of the riser assembly and defining an outlet axis, and a mounting flange including a plurality of circumferentially spaced openings configured to receive anchors, the plurality of circumferentially spaced openings including more than two elongated openings to provide for rotational adjustment of the mounting flange about the rotational axis relative to the anchors;

wherein the rotational axis is spaced apart from the outlet axis such that the outlet tube is eccentrically mounted relative to the inlet tube, thereby providing for lateral adjustment of the outlet tube as the mount flange and the supply elbow are rotated about the rotational axis.

2. The shower mounting system of claim 1, further comprising a supply anchor including a tubular body extending between an inlet end and an outlet end, the inlet end of the supply anchor coupled to the supply elbow, and the outlet end of the supply anchor coupled to the connector of the riser assembly.

3. The shower mounting system of claim 2, further comprising a supply adapter including an inlet end and an outlet end, the inlet end of the supply adapter configured to be threadably coupled to a supply pipe supported within a shower wall, and the outlet end of the supply adapter slidably receiving the inlet tube of the supply elbow.

4. The shower mounting system of claim 1, wherein the lower mount includes a mounting hub concentrically received around a control valve supported within the shower wall.

5. The shower mounting system of claim 4, further comprising a handle adapter received intermediate the control valve and the mounting hub.

6. The shower mounting system of claim 1, further comprising:

a shower arm including an inlet end and an outlet end, the inlet end of the shower arm fluidly coupled to the connector of the riser assembly; and a shower head fluidly coupled to the outlet end of the shower arm;

wherein the connector of the riser assembly includes a body having a first port, a second port, and a third port, the first port fluidly coupled to the outlet tube of the supply elbow, the second port fluidly coupled to the riser tube, and the third port fluidly coupled to the shower arm.

7. The shower mounting system of claim 6, further comprising:

a diverter valve supported by the lower end of the riser tube, the diverter valve including an inlet port, a first outlet port, a second outlet port, and a valve member configured to divert water flow from the inlet port to one of the first outlet port and the second outlet port; and wherein the riser assembly further includes a first fluid conduit received within the riser tube and extending between a lower end and an upper end, and a second fluid conduit received within the riser tube and extending parallel to the first fluid conduit between a lower end and an upper end.

8. The shower mounting system of claim 7, further comprising a hand shower supported by the riser tube and fluidly coupled to the second outlet port of the diverter valve, wherein the inlet end of the shower arm is fluidly coupled to the first outlet port of the diverter valve.

9. The shower mounting system of claim 8, further comprising a hand shower nest releasably supporting the hand shower and adjustable along the riser tube.

10. The shower mounting system of claim 1, further comprising an extension tube coupled to the lower end of the riser tube, and fluidly sealed from the riser tube, thereby allowing for axial adjustment of the distance between the lower mount and the upper mount.

11. A shower mounting system comprising:

a riser assembly including a riser tube extending between a lower end and an upper end, and a connector supported by the upper end of the riser tube, the riser assembly further including a first fluid conduit received within the riser tube and extending between a lower fluid coupler and an upper fluid coupler, and a second fluid conduit received within the riser tube and extending parallel to the first fluid conduit between a lower fluid coupler and an upper fluid coupler;

a lower mount operably coupled to the lower end of the riser tube;

a main control valve operably coupled to the lower mount and fluidly coupled to the riser assembly;

an upper mount operably coupled to the connector of the riser assembly, the upper mount configured to permit lateral adjustment of the upper end of the riser tube;

a diverter valve positioned intermediate the lower mount and the upper mount, the diverter valve fluidly coupled to the riser assembly; and an extension tube including an upper end and a lower end, the upper end of the extension tube operably coupled to the lower end of the riser tube, and fluidly sealed from the riser assembly, the lower end of the extension tube operably coupled to the lower mount, thereby allowing for axial adjustment of the distance between the lower mount and the upper mount.

12. The shower mounting system of claim 11, wherein:

the upper mount includes a supply elbow having a rearwardly facing inlet tube configured to be fluidly coupled to a water supply pipe supported by a shower wall and defining a rotational axis, and a forwardly facing outlet tube fluidly coupled to the connector of the riser assembly and defining an outlet axis; and the rotational axis is spaced apart from the outlet axis such that the outlet tube is eccentrically mounted relative to the inlet tube, thereby providing for lateral adjustment of the outlet tube as the supply elbow is rotated about the rotational axis.

13. The shower mounting system of claim 11, wherein the diverter valve includes an inlet port, a first outlet port, a second outlet port, and a valve member configured to divert water flow from the inlet port to one of the first outlet port and the second outlet port.

14. The shower mounting system of claim 12, further comprising:

a shower arm including an inlet end and an outlet end, the inlet end of the shower arm fluidly coupled to the connector of the riser assembly;

a shower head fluidly coupled to the outlet end of the shower arm; and wherein the connector of the riser assembly includes a body having a first port, a second port, a third port, and a fourth port, the first port fluidly coupled to the outlet tube of the supply elbow, the second port fluidly coupled to the first fluid conduit of the riser tube, the third port fluidly coupled to the second fluid conduit of the riser tube, and the fourth port fluidly coupled to the shower arm.

15. The shower mounting system of claim 14, further comprising a hand shower supported by the riser tube and fluidly coupled to the second outlet port of the diverter valve, wherein the inlet end of the shower arm is fluidly coupled to the first outlet port of the diverter valve.

16. The shower mounting system of claim 15, further comprising a hand shower nest releasably supporting the hand shower and adjustable along the riser tube.

17. The shower mounting system of claim 11, wherein the lower mount includes a mounting hub concentrically received around the main control valve supported within the shower wall.

18. A shower mounting system comprising:

a riser assembly including a riser tube extending between a lower end and an upper end, and a connector supported by the upper end of the riser tube, the riser assembly further including a first fluid conduit received within the riser tube and extending between a lower end and an upper end, and a second fluid conduit received within the riser tube and extending parallel to the first fluid conduit between a lower end and an upper end;

an upper mount operably coupled to the connector of the riser assembly;

a lower mount operably coupled to the lower end of the riser tube;

a main control valve operably coupled to the lower mount and fluidly coupled to the riser assembly;

a shower arm including an inlet end and an outlet end, the inlet end fluidly coupled to the connector of the riser assembly;

a shower head fluidly coupled to the outlet end of the shower arm;

a hand shower supported by the riser assembly; and a diverter valve supported by the lower end of the riser tube, the diverter valve configured to selectively divert water between the shower head and the hand shower;

wherein the upper mount is configured to permit lateral adjustment of the upper end of the riser tube;

the upper mount including a supply elbow having a rearwardly facing inlet tube configured to be fluidly coupled to a water supply pipe supported by a shower wall and defining a rotational axis, a forwardly facing outlet tube fluidly coupled to the connector of the riser assembly and defining an outlet axis, and a mounting flange including a plurality of circumferentially spaced openings to receive anchors;

the rotational axis is spaced apart from the outlet axis such that the outlet tube is eccentrically mounted relative to the inlet tube, thereby providing for lateral adjustment of the outlet tube as the supply elbow is rotated about the rotational axis; and an extension tube including an upper end and a lower end, the upper end of the extension tube operably coupled to the lower end of the riser tube, and fluidly sealed from the riser assembly, the lower end of the extension tube operably coupled to the lower mount, thereby allowing for axial adjustment of the distance between the lower mount and the upper mount.

19. The shower mounting system of claim 18, further comprising a supply adapter including an inlet end and an outlet end, the inlet end of the supply adapter configured to be threadably coupled to a supply pipe supported within a shower wall, and the outlet end of the supply adapter slidably receiving the inlet tube of the supply elbow.

* * * * *